US007585825B2

(12) United States Patent
Artiga Gonzalez et al.

(10) Patent No.: US 7,585,825 B2
(45) Date of Patent: Sep. 8, 2009

(54) SCENTED SOLID SUBSTANCES COMPRISING A NON-IONIC SURFACTANT-IMPREGNATED CARRIER

(75) Inventors: Rene-Andres Artiga Gonzalez, Düsseldorf (DE); Stefan Hammelstein, Düsseldorf (DE); Hubert Harth, Hilden (DE); Jürgen Hilsmann, Düsseldorf (DE); Mario Sturm, Leverkusen (DE); Andreas Bauer, Kaarst (DE); Wolfgang Lahn, Willich (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 11/546,179

(22) Filed: Oct. 10, 2006

(65) Prior Publication Data

US 2007/0111921 A1 May 17, 2007

Related U.S. Application Data

(63) Continuation of application No. PCT/EP2005/003418, filed on Apr. 1, 2005.

(30) Foreign Application Priority Data

Apr. 23, 2004 (DE) ..... 10 2004 020 400

(51) Int. Cl.
*C11D 3/50* (2006.01)
*C11D 7/14* (2006.01)
*C11D 1/66* (2006.01)

(52) U.S. Cl. ..... 510/101; 510/276; 510/315; 510/323; 510/349; 510/377; 510/441; 510/507; 510/532

(58) Field of Classification Search ..... 510/101, 510/276, 315, 323, 349, 377, 441, 507, 532
See application file for complete search history.

(56) References Cited

U.S. PATENT DOCUMENTS

| | | | | |
|---|---|---|---|---|
| 3,966,629 | A | 6/1976 | Dumbrell | |
| 4,062,647 | A | 12/1977 | Storm et al. | |
| 4,082,682 | A * | 4/1978 | Inamorato et al. | 510/324 |
| 4,536,315 | A | 8/1985 | Ramachandran et al. | |
| 4,737,306 | A | 4/1988 | Wichelhaus et al. | |
| 4,820,439 | A | 4/1989 | Rieck | |
| 5,104,568 | A * | 4/1992 | Shaw et al. | 510/361 |
| 5,132,036 | A * | 7/1992 | Falou et al. | 510/277 |
| 5,219,549 | A * | 6/1993 | Onda et al. | 423/415.2 |
| 5,454,982 | A * | 10/1995 | Murch et al. | 510/350 |
| 5,670,466 | A * | 9/1997 | Sivik et al. | 510/102 |
| 5,691,303 | A * | 11/1997 | Pan et al. | 512/4 |
| 5,736,502 | A * | 4/1998 | Wilkinson | 510/444 |
| 5,780,420 | A | 7/1998 | Breuer et al. | |
| 6,133,227 | A * | 10/2000 | Barnabas et al. | 510/530 |
| 6,221,826 | B1 * | 4/2001 | Surutzidis et al. | 510/349 |
| 6,339,055 | B1 * | 1/2002 | Brooker et al. | 510/301 |
| 6,492,316 | B1 * | 12/2002 | Herbots et al. | 510/392 |
| 6,562,769 | B1 | 5/2003 | Paatz et al. | |
| 6,716,807 | B2 * | 4/2004 | Van der Hoeven et al. | 510/350 |
| 7,049,274 | B2 * | 5/2006 | Ranade et al. | 510/101 |

FOREIGN PATENT DOCUMENTS

| | | |
|---|---|---|
| DE | 2334899 | 1/1974 |
| DE | 3526405 | 2/1987 |
| DE | 3911363 | 11/1990 |
| DE | 4133862 | 4/1993 |
| DE | 4400024 | 7/1995 |
| DE | 19530999 | 2/1997 |
| DE | 19735783 | 2/1999 |
| EP | 0026529 | 4/1981 |
| EP | 0028432 | 5/1981 |
| EP | 0164514 | 12/1985 |
| JP | 58217598 | 12/1983 |
| WO | WO9013533 | 11/1990 |
| WO | WO9425563 | 11/1994 |
| WO | WO9507331 | 3/1995 |
| WO | WO9729176 | 8/1997 |
| WO | WO9729177 | 8/1997 |
| WO | WO9734982 | 9/1997 |
| WO | WO9921953 | 5/1999 |
| WO | WO2004006967 | 1/2004 |

* cited by examiner

*Primary Examiner*—Charles I Boyer
(74) *Attorney, Agent, or Firm*—David P. LeCroy

(57) ABSTRACT

Particles which comprise a specified inorganic carrier material, perfume and nonionic surfactant(s) in quantities of at least 0.1% by weight, a method for producing the particles, a detergent composition comprising the particles, and a method for washing textiles with the aid of the detergent composition.

11 Claims, No Drawings

SCENTED SOLID SUBSTANCES COMPRISING A NON-IONIC SURFACTANT-IMPREGNATED CARRIER

CROSS-REFERENCE TO RELATED APPLICATIONS

This application is a continuation under 35 U.S.C. § 365(c) and 35 U.S.C. § 120 of International Application PCT/EP2005/003418, filed Apr. 1, 2005. This application also claims priority under 35 U.S.C. § 119 of German Application DE 10 2004 020 400.4, filed Apr. 23, 2004. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention relates to particles that comprise a specific inorganic carrier material in a minimum amount of 30 wt. %, perfume and nonionic surfactant(s) in amounts of at least 0.1 wt. %, to a process for manufacturing such particles, to a detergent composition comprising such particles, and to a method for washing textiles with the help of this detergent composition.

In the washing, treatment and after treatment of laundry, it is now common practice to add small amounts of perfume to the detergents and after treatment compositions in order to confer a pleasant fragrance to the wash- or rinse liquor itself and also to the laundry treated with the wash- or rinse liquor. In addition, besides color and appearance, the perfuming of detergents and after treatment compositions is an important aspect of the aesthetic product impression and an important factor in the consumer deciding for or against a certain product. For perfuming, the perfume may either be directly incorporated into the composition or may be added to the wash or rinse liquor in an additional step. The first method establishes a certain product characteristic whereas, in the second method, the consumer can individually choose his or her fragrance from the various fragrance variants on offer—as is the case for the choice of an eau-de-toilette or an aftershave lotion.

(2) Description of Related Art, Including Information Disclosed Under 37 C.F.R. §§ 1.97 and 1.98

Accordingly, scented molded articles and processes for perfuming wash- and rinse liquors are extensively described in the prior art. Thus, DE 41 33 862 (Henkel) discloses tablets containing carrier materials, fragrances and optionally other typical detergent and cleansing agent ingredients, wherein sorbitol is the carrier material and in addition 20 to 70% by weight of an effervescent system of carbonate and acid are employed. These tablets, which may be added, for example, in the after-rinse cycle or fabric softening cycle of a household washing machine, comprise about 3 to 15% by weight and preferably 5 to 10% by weight of fragrance. As a result of their high disintegrator content, the tablets are sensitive to atmospheric moisture and have to be stored in a suitably protected manner.

In DE 39 11 363 (Baron Freytag von Loringhoven) a process is described for the production of a fragrance-enriched wash- or rinse liquor and a fragrance additive composition suitable for this purpose. The additive compositions, present in the form of capsules or tablets, comprise the fragrance together with an emulsifier in liquid form (capsules) or fixed to fillers and carrier materials (tablets), sodium aluminum silicates and cyclodextrins being cited as the carrier materials. The fragrance content of the capsules or tablets is at least 1 g for a capsule or tablet volume of more than 1 $cm^3$. Tablets or capsules containing more than 2.5 g of fragrance for a volume of at least 5 $cm^3$ are preferred. For storage, tablets or capsules of the type in question have to be provided with a gas- and water-tight outer layer to protect the ingredients. This publication does not provide any further details of the production or the physical properties of suitable tablets.

In International Patent Application WO 94/25563 (Henkel-Ecolab) a process is described for the production of molded bodies of detergents and active cleansers by means of the microwave technique that does not involve any high-pressure tableting. The molded bodies produced by this process are characterized by an extremely high rate of dissolution or disintegration coupled with fracture resistance without the need for a disintegrator. At the same time, they are storage stable and can be stored without any additional precautions. Molded bodies with a perfume oil content of 1 to 3% by weight that is typical for detergents and cleansing agents, can also be produced by this process. In general, perfume oils are readily volatile and, accordingly, could even evaporate on exposure to microwave radiation. If, therefore, relatively high levels of readily volatile liquid substances are to be used, then a two-component system consisting of a component produced by the microwave technique and a component comprising the sensitive liquid substances is described.

Particulate additives for perfuming wash liquors and for use in detergents and cleansing agents, together with processes for their production, are described in International Patent Applications WO 97/29176 and WO 97/29177 (Procter & Gamble). According to the teaching of these documents, perfume is added to porous carrier materials (for example, a mixture of sucrose and zeolite X), a coating material (carbohydrates) is then applied and the required particle size distribution is established.

German patent application DE 197 35 783 A1 (Henkel) describes highly concentrated scented molded bodies comprising carrier material(s), 20 to 50% by weight of fragrance (s) and optionally other auxiliaries and additives typical of detergents and cleansing agents, wherein at least 50% by weight of the molded bodies—after subtracting the quantity of fragrance—consists of fatty acids and fatty acid salts. These scented molded bodies are suitable both for perfuming detergents and cleansing agents and for perfuming laundry in a washing machine.

A process for applying fragrances to laundry in a washing machine is described in DE 195 30 999 (Henkel). In this process, a fragrance-containing molded body produced by exposure to microwave radiation is used in the final rinse cycle of a washing machine. According to the teaching of this document, the preferably spherically shaped bodies with diameters above 3 mm and bulk densities of up to 1,100 g/l are produced by introducing a mixture of predominantly water-soluble carrier materials, hydrated substances, optionally surfactants and perfume into suitable molds and sintering the mixture by exposure to microwave radiation. The fragrance contents of the molded bodies are between 8 and 40% by weight and the carrier materials used include starches, silicas, silicates and disilicates, phosphates, zeolites, alkaline salts of polycarboxylic acids, oxidation products of polyglucosans and polyaspartic acids. A crucial pre-condition of the process described in this document for producing shaped bodies is that to form molded bodies, at least partly bound water should be present in the mixture to be sintered by microwave radiation i.e. the starting materials should be at least partly present in hydrated form.

The proposed solutions cited in the prior art require either additional barrier layers or coating layers to fix the perfume to the carrier, or are not equally suitable for perfuming detergents and cleansing agents, and for direct use as the sole fragrance, for example, in the final rinse cycle of a washing machine.

BRIEF SUMMARY OF THE INVENTION

From this background, the object of the present invention was to provide a solid dosage form for fragrances, which can carry substantial amounts of fragrance, and which can be incorporated without a gas-tight coating layer into customary detergents and cleansing agents.

The subject matter of the invention is a particle that comprises inorganic carrier material, selected from the group comprising zeolites, sulfates, carbonates, silicates, silica and/or mixtures thereof, together with perfume that is adsorbed on the carrier material and/or absorbed in the carrier material, wherein the particle comprises at least 0.1 wt. % of nonionic surfactant(s), based on the total particle.

The carrier material is preferably impregnated with the nonionic surfactant, i.e. the nonionic surfactant is essentially dispersed in the carrier material and, in particular, does not significantly enrich the surface of the carrier material.

Surprisingly, a series of advantages have resulted from the subject matter of the invention. Hence, it was found that the inventive particles, when compared with the corresponding particles without nonionic surfactant, yielded a more intensive perception of the fragrance to consumers, when, for example, clothes were washed with a detergent formulation that included the inventive particles. Surprisingly, it was found that the consumer perceives a more intensive fragrance from the washed laundry in comparison with laundry that was washed with a conventionally perfumed detergent formulation, even when the actual quantity of perfume comprised therein was identical. Inasmuch, the invention augments the fragrant effect that directly concern the particles and objects in which these particles are incorporated, for example, detergent formulations and things, such as textiles, that are treated with the objects (in this case, the detergent formulation).

Surprisingly, a further advantage of the inventive particles is that the perfume component incorporated in the particle is stabilized in comparison with an otherwise comparable particle that is exempt from nonionic surfactant. It is often the case that perfume that is incorporated in a carrier material partially decomposes, more or less slowly, in the carrier material. In an inventive particle, on the other hand, this decomposition is at least retarded. The invention thus affords a perfume-stabilizing effect. This is particularly true when the particle is incorporated into an object, such as, for example, in a detergent formulation, which, due to its characteristics, for example, its alkalinity, is rather detrimental to the stability of the perfume. Here, the perfume-stabilizing effect has a particularly favorable influence.

Moreover, it was surprisingly observed that the perception of fragrance resulting from the inventive particles directly and indirectly lasts longer. In this context, the term "indirectly" means that the inventive particle is fragrant for a longer time than an otherwise comparable particle that is exempt from nonionic surfactant, but which comprises the same amount of perfume. The term "directly" in this context means that objects (e.g. detergent formulations) that include the inventive particle are fragrant for a longer time and that even when using these objects (e.g. detergent formulations for washing textiles), the thus treated things (in this case the laundered textiles), are fragrant for a longer time.

The invention also affords a delayed action fragrance (perception), wherein this delayed action fragrance (i.e. the prolongation of the fragrance perception), relates to the particles, to the objects comprising the particles and to the things that are treated with these objects.

Surprisingly, a major advantage of the invention is that the incorporation or presence of the nonionic surfactant enables the carrier material of the particles to be loaded with greater amounts of perfume. In the absence of nonionic surfactant, comparatively smaller amounts of perfume can only be taken up. This is particularly surprising, because one would think that the amount of perfume that could be assimilated by the carrier material should sink when the carrier material has to accept a certain amount of an additional substance. The invention also affords an improvement, particularly even a maximization of the perfume loading capacity of the carrier material, such that a level of perfume loading of the carrier material is enabled that could not previously be attained (in the absence of nonionic surfactant).

BRIEF DESCRIPTION OF THE SEVERAL VIEWS OF THE DRAWING(S)

Not Applicable

DETAILED DESCRIPTION OF THE INVENTION

The term perfume includes perfume oils, fragrances and odoriferous materials. Suitable perfume oils or fragrances include individual perfume compounds, for example, synthetic products of the ester, ether, aldehyde, ketone, alcohol and hydrocarbon type. Perfume compounds of the ester type are, for example, benzyl acetate, phenoxyethyl isobutyrate, p-tert.-butylcyclohexyl acetate, linalyl acetate, dimethylbenzyl carbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate and jasmecyclate. The ethers include, for example, benzyl ethyl ether and ambroxan; the aldehydes include, for example, the linear alkanals containing 8 to 18 carbon atoms, citral, citronellal, citronellyloxyacetaldehyde, cyclamen aldehyde, lilial and bourgeonal; the ketones include, for example, the ionones, α-isomethyl ionone and methyl cedryl ketone; the alcohols include anethol, citronellol, eugenol, geraniol, linalool, phenylethyl alcohol and terpineol and the hydrocarbons include, above all, the terpenes, such as limonene and pinene. However, mixtures of various odoriferous substances, which together produce an attractive perfume note, are preferably used.

Perfume oils such as these may also contain natural perfume mixtures obtainable from vegetal sources, for example, pine, citrus, jasmine, patchouli, rose or ylang-ylang oil. Also suitable are muscatel sage oil, chamomile oil, clove oil, melissa oil, mint oil, cinnamon leaf oil, lime blossom oil, juniper berry oil, vetivert oil, olibanum oil, galbanum oil and laudanum oil and orange blossom oil, neroli oil, orange peel oil and sandalwood oil.

The volatility of a perfume is crucial for its perceptibility, whereby in addition to the nature of the functional groups and the structure of the chemical compound, the molecular weight also plays a role. Thus, the majority of perfumes have molecular weights up to 200 daltons, and molecular weights of 300 daltons and above are quite an exception. Due to the different volatilities of perfumes, the smell of a perfume or fragrance composed of a plurality of odorous substances changes during evaporation, the impressions of odor being subdivided into the "top note," "middle note" or "body" and "end note" or "dry out." As the perception of smell also depends to a large extent on the intensity of the odor, the top note of a perfume or fragrance consists not solely from highly volatile compounds, whereas the endnote consists to a large extent from less volatile, i.e. tenacious odorous substances.

Exemplary tenacious odorous substances that are advantageously utilizable in the present invention are the ethereal oils such as angelica root oil, aniseed oil, arnica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiacum wood oil, Indian wood oil, helichrysum oil, ho oil, ginger oil, iris oil, cajuput oil, sweet flag oil, camomile oil, camphor oil, Canoga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, Palma Rosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil.

However, in the context of the present invention, the higher boiling or solid odoriferous substances of natural or synthetic origin can be used as tenacious odoriferous substances or mixtures thereof, namely fragrances. These compounds include the following compounds and their mixtures: ambrettolide, α-amyl cinnamaldehyde, anethol, anisaldehyde, anis alcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valeriate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl-n-amyl ketone, methyl anthranilic acid methyl ester, p-methyl acetophenone, methyl chavicol, p-methyl quinoline, methyl-β-naphthyl ketone, methyl-n-nonyl acetaldehyde, methyl-n-nonyl ketone, muskone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymine, thymol, γ-undecalactone, vanillin, veratrum aldehyde, cinnamaldehyde, cinnamyl alcohol, cinnamic acid, ethyl cinnamate, benzyl cinnamate.

In the context of the present invention, advantageously utilizable volatile odoriferous substances particularly include the low boiling odoriferous substances of natural or synthetic origin that can be used as alone or in mixtures. Exemplary readily volatile odoriferous substances are alkyl isothiocyanates (alkyl mustard oils), butanedione, limonene, linalool, linalyl acetate and linalyl propionate, menthol, menthone, methyl-n-heptenone, phellandrene, phenyl acetaldehyde, terpinyl acetate, citral, citronellal.

According to the present invention, all of the above-mentioned odoriferous substances, alone or in mixture, are utilizable with the already cited advantages.

The inorganic carrier material is selected from the group comprising zeolites, sulfates, carbonates, silicates, silica and/or their mixtures. The preferred mixtures are the following:

zeolite-sulfate, zeolite-sulfate-carbonate, zeolite-sulfate-carbonate-silicate, zeolite-sulfate-carbonate-silicate-silica, zeolite-carbonate, zeolite-carbonate-silicate, zeolite-carbonate-silicate-silica, zeolite-silicate, zeolite-silicate-sulfate, zeolite-silicate-carbonate, zeolite-silicate-silica, zeolite-silica, zeolite-silica-sulfate, zeolite-silica-carbonate, sulfate-carbonate, sulfate-carbonate-silicate, sulfate-carbonate-silicate-silica, sulfate-silicate, sulfate-silica, carbonate-silicate, carbonate-silica.

Of the suitable fine crystalline, synthetic zeolites containing bound water, zeolite A and/or P are preferred. Zeolite MAP® (commercial product of the Crossfield company), for example, is particularly preferred as the zeolite P. Zeolite X and mixtures of A, X and/or P, for example, a cocrystal of zeolites A and X, the Vegobond® AX (commercial product of Condea Augusta S.p.A.) are similarly preferred. Preferably, the zeolite can be employed as the spray-dried powder or also advantageously as the non-dried, still moist from its manufacture, stabilized suspension. Zeolite of the Y type is also preferred.

Silicates, particularly amorphous and crystalline-layered silicates are also preferred.

Inventive carrier materials are particularly the crystalline, layered sodium silicates corresponding to the general formula $NaMSi_xO2_{x+1}\ yH_2O$, wherein M is sodium or hydrogen, x is a number from 1.9 to 4 and y is a number from 0 to 20, preferred values for x being 2, 3 or 4. These types of crystalline layered silicates are described, for example, in European Patent Application EP-A-0 164 514. Preferred crystalline layered silicates of the given formula are those in which M stands for sodium and x assumes the values 2 or 3. Both β- and δ-sodium disilicates $Na_2Si_2O_5\ yH_2O$ are preferred.

Preferred builders that can be used as carrier materials also include amorphous sodium silicates with a modulus ($Na_2O$:$SiO_2$ ratio) of 1:2 to 1:3.3, preferably 1:2 to 1:2.8 and more preferably 1:2 to 1:2.6, which exhibit secondary wash cycle properties. The delay in dissolution compared with conventional amorphous sodium silicates can have been obtained in various ways, for example, by surface treatment, compounding, compressing/compacting or by over-drying. In the context of this invention, the term "amorphous" also means "X-ray amorphous". In other words, the silicates do not produce any of the sharp X-ray reflexes typical of crystalline substances in X-ray diffraction experiments, but at best one or more maxima of the scattered X-radiation, which have a width of several degrees of the diffraction angle. However, particularly good builder properties may even be achieved where the silicate particles produce indistinct or even sharp diffraction maxima in electron diffraction experiments. This is to be interpreted to mean that the products have microcrystalline regions between 10 and a few hundred nm in size, values of up to at most 50 nm and especially up to at most 20 nm being preferred. This type of X-ray amorphous silicates, which similarly possess a delayed dissolution in comparison with the customary water glasses, are described, for example, in German Patent Application DE-A-44 00 024. Compacted/ densified amorphous silicates, compounded amorphous silicates and over dried X-ray-amorphous silicates are particularly preferred.

Additional suitable carrier materials are layered silicates of natural and synthetic origin. These types of layered silicates are known, for example, from the patent applications DE-B-23 34 899, EP-A-0 026 529 and DE-A-35 26 405. Their usability is not limited to a specific composition or structural formula. However, smectites, particularly bentonites are preferred.

Layered silicates that belong to the group of water-swellable smectites, for example, montmorillonite, hectorite or saponite, can be used as carrier materials. In addition, low amounts of iron can be incorporated into the crystal lattice of the layered silicates of the above formulas. Moreover, due to their ion-exchange properties, the layered silicates can comprise hydrogen-, alkali-, alkaline earth ions, particularly $Na^+$ and $Ca^{2+}$. The quantity of water of hydration is mostly in the range 8 to 20 wt. % and depends on the swelling and the type of processing. Usable layered silicates are known, for example, from U.S. Pat. No. 3,966,629, EP-A-0 026 529 and EP-A-0 028 432. Preferably, layered silicates are used that due to their alkaline treatment are essentially free of calcium and strongly coloring iron ions.

Particularly preferred carrier materials are alkali metal carbonates and alkali metal bicarbonates, wherein the preferred embodiments include sodium- and potassium carbonate and particularly sodium carbonate.

Particularly preferred carrier materials are also the sulfates, preferably alkali metal- and alkaline earth metal sulfates, wherein sodium- and magnesium sulfate, particularly sodium sulfate are explicitly preferred.

Particularly preferred carrier materials are also the silicas, preferably the precipitated silicas, particularly the silica gels that are advantageously hydrophobic or hydrophilic.

According to a preferred embodiment of the invention, the particles comprise more than 0.25 wt. %, advantageously more than 0.5 wt. %, preferably more than 0.75 wt. %, particularly more than 1.0 wt. % of nonionic surfactant(s), wherein an upper limit of preferably 30 wt. %, advantageously 20 wt. %, more advantageously 10 wt. %, further advantageously 5 wt. %, even more advantageously 4 wt. %, particularly 3 wt. % is not exceeded.

According to a further preferred embodiment, the particle comprises the inorganic carrier material in a total amount of at least 40 wt. %, preferably at least 50 wt. %, advantageously at least 60 wt. %, particularly at least 70 wt. %.

A further preferred embodiment of the invention is when the quantity of the perfume ab/adsorbed in/on the carrier material is at least 5 wt. %, advantageously more than 10 wt. %, more advantageously more than 15 wt. %, further advantageously more than 20 wt. %, particularly more than 25 wt. %, based on the whole particle.

A preferred embodiment of the invention is when the nonionic surfactant is selected from the group of the alkoxylated alcohols, the alkylphenol polyglycol ethers, the alkoxylated fatty acid alkyl esters, the polyhydroxyfatty acid amides, the alkyl glycosides, the alkyl polyglucosides, the amine oxides and/or the long chain alkyl sulfoxides.

According to a further preferred embodiment of the invention, alkoxylated alcohol is at least partially comprised as the nonionic surfactant, preferably in amounts of at least 40 wt. %, advantageously at least 50 wt. %, further advantageously at least 60 wt. %, extremely advantageously at least 70 wt. %, even more advantageously at least 80 wt. %, particularly at least 90 wt. %, most advantageously in amounts of 100 wt. %, each based on the total amount of nonionic surfactant comprised in the particle. Again, a preferred embodiment of the invention concerns in this case alkoxylated, advantageously ethoxylated, particularly primary alcohols preferably containing 8 to 18, particularly 12 to 18 carbon atoms and, on average, 1 to 12 moles of alkylene oxide, preferably ethylene oxide (EO) per mole of alcohol.

It was surprisingly discovered that precisely the alkoxylated alcohols are very advantageous for maximizing the ability of the particle to take-up perfume, for benefiting the stability of the perfume in the particle and for promoting the cited delayed fragrance effect and the fragrance enhancing effect.

According to a further preferred embodiment, the nonionic surfactants concern a mixture of at least two different nonionic surfactants, preferably at least two different alkoxylated, advantageously ethoxylated, particularly primary alcohols, wherein the alkoxylated alcohols are differentiated, preferably in regard to their degree of alkoxylation.

A further preferred embodiment of the invention is when this mixture of at least two nonionic surfactants comprises an alkoxylated, preferably ethoxylated alcohol with a degree of alkoxylation of less than 7, advantageously not more than 6, further advantageously not more than 5, particularly not more than 4.5 and at least one additional alkoxylated, preferably ethoxylated alcohol with a degree of alkoxylation of at least 7.

According to a further preferred embodiment of the invention, the ratio of the lower alkoxylated alcohol to the higher alkoxylated alcohol is in the range 5:1 to 1:5, preferably 4:1 to 1:4, advantageously 3:1 to 1:3, particularly 2:1 to 1:2.

According to the invention, the carrier consists of the cited inorganic carrier material and may consist of a single carrier material or is also composed of a plurality of carrier materials. However, it is also possible that the carrier partially comprises further carrier materials beside the inventive inorganic carrier materials. Additional carrier materials of this type are preferably comprised in amounts below 50 wt. %, advantageously below 40 wt. %, further advantageously below 30 wt. %, more advantageously in amounts below 20 wt. %, even more advantageously in amounts below 10 wt. %, most advantageously in amounts below 5 wt. %, particularly in amounts below 1 wt. % (i.e. down to the extreme of freedom from these additional carrier materials), based on the total carrier material (i.e. the sum of inorganic carrier material and additional carrier material). Additional carrier materials of this type are preferably porous solids, in particular selected from the group of the surfactants, surfactant compounds, citrates, alkali metal phosphates, chitin microspheres, pectin, gums, gelatins, resins, starches, particularly porous starches, modified starches and/or carboxy alkyl starches, di- and/or polysaccharides, cyclodextrins, maltodextrins, (co-)polymers, preferably synthetic (co-)polymers, particularly water-soluble (co-)polymers and/or terpolymers and mixtures thereof.

Accordingly, the carrier material can also partially comprise one or a plurality of (co-)polymers as the carrier, which are preferably selected at least partially from the following groups (a) Homopolymers, selected from polyvinyl compounds such as preferably polyvinyl acetates, polyvinyl alcohol and/or polyvinyl pyrrolidone, polycarboxylic acids such as preferably polyacrylic acid and/or polymethacrylic acid; polysulfonic acids, such as preferably polystyrene sulfonic acids, polyesters, such as preferably glycol polyacrylates; polyamides, polyacrylamides, polyurethanes, preferably polyurethanes that carry ionic groups, for example, carboxylic groups, sulfonic acid groups or tertiary amines or polyurethanes, that preferably comprise nonionic hydrophilic groups, such as ethylene oxide, polyethylene oxide, polypropylene oxide and polyalkylene glycol derivatives.

(b) Polycondensates, such as preferably ethoxylated phenol, formaldehyde resins, preferably sulfonated aromatic formaldehyde resins, urea or melamines, formaldehyde compounds, polyamides, polyamines, and epichlorohydrin resins (c) AB-Copolymers in which A represents a more water-soluble or water-swellable group and B a less water-soluble or water-swellable group, preferably selected from styrene copolymers, such as, in particular styrene-acrylic acid polymers or styrene-ethylene oxide polymers, copolymers of polyvinyl and maleic acid compounds, such as preferably styrene-maleic anhydride polymers or vinyl acetate, maleic acid ester polymers, polyvinyl-polyalkylene copolymers, such as preferably vinyl acetate-ethylene polymers, ethylene-acrylic acid-acrylic ester polymers or ethylene-acrylic acid-acrylonitrile polymers, vinyl copolymers, such as preferably vinyl acetate polymers, acrylic acid-acrylonitrile polymers, acrylic acid-acrylamide polymers;

(d) ABA block copolymers wherein "A" stands for water-soluble or water-swellable groups such as preferably polyethylene oxide, polyvinyl alcohol, polyacrylamide, polyacrylic acid, polyvinyl pyrrolidone, or polycaprolactone and "B" for less water-soluble or hardly water-soluble, such as preferably polypropylene oxide, polyvinyl acetate, polyvinyl butyral, polylauryl methacrylate, polystyrene, polyhydroxystearic acid, polysiloxanes, (e) AB graft (co)polymers, wherein "A" are water-soluble or water-swellable groups such as preferably vinyl alcohol, vinyl acetate, ethylene oxide, propylene oxides, vinyl sulphonate, acrylic acid and vinylamines (f) natural polymers such as preferably cellulose derivatives, such as in particular carboxymethyl cellulose, hydroxypropyl cellulose, methyl cellulose and/or their derivatives.

In this context, particularly polymers are to be cited that preferably at least partially comprise monomers selected from isobutyl methacrylate, n-butyl acrylate, n-butyl methacrylate, isobutyl acrylate, n-propyl acrylate, iso-propyl methacrylate, methyl methacrylate, styrene, decyl(meth) acrylate, dodecyl (meth)acrylate, tetradecyl(meth)acrylate and/or hexadecyl(meth)acrylate and mixtures thereof.

Nevertheless, the inorganic carrier material is particularly preferred and a preferred embodiment of the invention is represented by an inorganic carrier material consisting of at least 40 wt. %, preferably at least 50 wt. %, advantageously at least 60 wt. %, further advantageously at least 70 wt. %, more advantageously at least 80 wt. %, even more advantageously at least 90 wt. %, particularly entirely of zeolites, preferably zeolite X, Y, A, P, MAP and/or mixtures thereof.

Preferably, the zeolite should comprise less than 15 wt. %, advantageously less than 8 wt. %, particularly less than 5 wt. % of desorbable water. Such zeolites can be obtained, for example, by activating or dehydrating the zeolite at temperatures of 150° C. to 350° C., optionally under reduced pressure (advantageously at ca. 0.001 to ca. 20 torr). This would then be referred to as activated/dehydrated zeolite.

In addition to the inventively available nonionic surfactant, the carrier material may also at least partially comprise tensidic carriers. Any surfactant or surfactant compound, solid at temperatures of up to 40° C., can be added as the tensidic carrier. In the context of the present invention, the term "surfactant compound" is understood to mean a surfactant-containing preparation that comprises at least 20 wt. % of a preferably anionic surfactant, based on the surfactant compound. Here, the additional carriers comprised in the surfactant compounds are preferably identical to the previously mentioned inventive carriers.

In addition, the carrier material may also comprise one or a plurality of anionic surfactant compounds or anionic surfactants as the carrier. In this case, exemplary anionic surfactant compounds are alkylbenzene sulfonate (ABS) compounds on silicate- or zeolite carriers with ABS contents of, for example, 10, 15, 20 or 30 wt. %, fatty alcohol sulfate (FAS) compounds on silicate-, zeolite- or sodium sulfate carriers with active substance contents of, for example, 50-70, 80 or 90 wt. %, as well as anionic surfactant-containing compounds based on sodium carbonate/sodium silicate with anionic surfactant contents above 40 wt. %.

In the context of the present invention, the carrier material can also comprise the pure anionic surfactants as the carrier, in so far that they are solid and that their use is not proscribed due to possible hygroscopicity. In particular, soaps are preferred here as pure anionic tensidic carriers, as firstly they can remain solid up to high temperatures, and secondly they do not cause any problem in regard to an unwanted water absorption. Any fatty acid salt can be used as the soap. Whereas in principle, e.g. aluminum-, alkaline earth- and alkali metal salts of the fatty acids can be used, those, which comprise the alkali metal, are preferred and from these, the sodium salts of the fatty acids are once again preferred. Any acid obtained from vegetal or animal oils and fats can be used as the fatty acid whose salts can be comprised in the carrier as the carrier material. The fatty acids can be saturated or mono- to polyunsaturated. Of course, not only "pure" fatty acids can be used, but also the industrial fatty acid mixtures, obtained by cleaving fats and oils, for example, palm nut-, coco- peanut- or colza oil or suet, these mixtures being once again distinctly preferred on economic grounds.

The carrier material can comprise single or mixed salts of the following acids as the carrier: caprylic acid, pelargonic acid, capric acid, lauric acid, myristic acid, palmitic acid, stearic acid, octadecan-12-ol-ic acid, arachinic acid, behenic acid, lignoceryl acid, cerotic acid, melissyl acid, 10-undecenic acid, petroselic acid, petroselaidic acid, oleic acid, elaidic acid, ricinoleic acid, linolaidic acid, gadoleic acid, erucaoic acid, brassidic acid. Naturally, the salts of fatty acid with an odd number of carbon atoms can also be employed, for example, the salts of undecanoic acid, tridecanoic acid, pentadecanoic acid, heptadecanoic acid, nonadecanoic acid, heneicosanoic acid, tricosanoic acid, pentacosanoic acid, heptacosanoic acid.

The carrier material can also comprise as the carrier(s) one or a plurality of substances from the group of the sodium salts of saturated or unsaturated $C_{8-24}$ fatty acids, preferably saturated or unsaturated $C_{12-18}$ fatty acids and particularly saturated or unsaturated $C_{16}$ fatty acids.

Additional suitable carriers that can be comprised in the carrier material are, for example, di- and polysaccharides, wherein a broad spectrum of substances can be used ranging from saccharose and maltose through oligosaccharides to the "classical" polysaccharides such as cellulose and starch as well as their derivatives. Among the substances from these sub-groups, the starches are once again particularly preferred.

Useful and preferred organic carriers that can be comprised in the carrier material are, for example, the polycarboxylic acids usable in the form of their alkaline and especially sodium salts, such as citric acid, adipic acid, succinic acid, glutaric acid, tartaric acid, maleic acid, fumaric acid, sugar acids, aminocarboxylic acids, nitrilotriacetic acid (NTA), providing such a use is not ecologically unsafe, and mixtures thereof. Preferred salts are the salts of polycarboxylic acids such as citric acid, adipic acid, succinic acid, glutaric acid, tartaric acid, sugar acids and mixtures thereof.

Acids per se can also be comprised as carriers in the carrier material. Besides their characteristics of a carrier substance, the acids also typically have the property of an acidifying component and, hence also serve to establish a relatively low and mild pH in detergents and cleansing agents. Citric acid, succinic acid, glutaric acid, adipic acid, gluconic acid and any mixtures thereof are particularly mentioned in this regard. Preferably, anhydrous acids are added.

Polymeric polycarboxylates can also be comprised in the carrier material as the carrier; they are e.g. the alkali metal salts of polyacrylic or polymethacrylic acid, for example, those with a relative molecular weight of 500 to 70,000 g/mol. The molecular weights mentioned in this specification for polymeric polycarboxylates are weight-average molecular weights $M_w$ of the particular acid form which, fundamentally, were determined by gel permeation chromatography (GPC), equipped with a UV detector. The measurement was carried out against an external polyacrylic acid standard, which provides realistic molecular weight values by virtue of its structural similarity to the polymers investigated. These values differ significantly from the molecular weights measured against polystyrene sulfonic acids as standard. The molecular weights measured against polystyrene sulfonic acids are generally significantly higher than the molecular weights mentioned in this specification.

If the carrier material is porous, preferably with a porous structure, then this is an advantage for the perfume receptivity of the carrier material.

According to a further preferred embodiment, the pore size of the carrier material is essentially at least 6 Angstroms, preferably essentially in the range from 7 to 50 Angstroms such that therefore at least 40%, advantageously at least 50%, more advantageously 60%, even more advantageously at least 70%, preferably at least 80%, particularly 90% of the pores of the carrier material meet this pore size requirement.

Compliance with this pore size criterion results in a more advantageous incorporation of the perfume into the pores of the carrier material.

If the pore volume of the carrier material is at least 0.1 ml/g, preferably at least 0.2 ml/g, in particular does not exceed a value of 2.5 ml/g, then this also illustrates a preferred embodiment of the invention.

According to a further preferred embodiment, the carrier material has a hygroscopicity value of less than 80%, preferably less than 50%, in particular less than 30%.

The term "hygroscopicity value" is understood to mean the degree of moisture absorption that corresponds to the weight increase of the particles according to the following test method. The hygroscopicity value is determined by adding 2 grams of the particles into a 50 ml beaker and storing it at 32° C. in air of 80% relative humidity. The percentage increase in weight of the particles, based on the starting weight corresponds to the hygroscopicity value in percent.

If the carrier material comprises, besides perfume and nonionic surfactant, a further component, preferably selected from bleaches, bleach activator, bleach catalyst, sequestrant, threshold inhibitor, color transfer inhibitor, photobleaches, enzymes, softeners, pH adjustors, then this also constitutes a preferred embodiment.

According to a further preferred embodiment, the carrier comprises less than 15 wt. %, preferably less than 8 wt. %, in particular less than 5 wt. % of desorbable water.

If the particle size of the individual particles is essentially between 0.005 and 1.0 mm, then this is also a further preferred embodiment of the invention. Here, the term "essentially" means that at least 40 wt. %, advantageously at least 50 wt. %, further advantageously at least 60 wt. %, even more advantageously at least 70 wt. %, preferably at least 80 wt. % particularly 90 wt. % of the particles meet this particle size requirement.

If the inventive particles are agglomerated, wherein the size of the agglomerate is preferably essentially 100-2,000 μm, particularly essentially 100-800 μm, then this again constitutes a preferred embodiment of the invention. Here, the term "essentially" means that at least 40 wt. %, advantageously at least 50 wt. %, further advantageously at least 60 wt. %, even more advantageously at least 70 wt. %, preferably at least 80 wt. % particularly 90 wt. % of the agglomerate have the cited agglomerate size. On contact with water, these agglomerated particles preferably disintegrate again into smaller particles from which the agglomerates are/were composed. In some cases, the size of the agglomerate can be in the range 0.1 to 30 mm, if this is required for the technical application.

If the boiling points of the individual fragrances that are ad/absorbed on/in the carrier material are largely below 300° C., then this constitutes a preferred embodiment of the invention, wherein preferably at least 50% of the comprised fragrances have a boiling point below 300° C., advantageously at least 60%, further advantageously at least 70%, even more advantageously at least 80%, most advantageously 90%, particularly even 100%.

Boiling points below 300° C. are consequently advantageous as the fragrances with higher boiling points would exhibit too low a volatility. However, in order to allow the particle to partially "effuse" and develop fragrance, a certain volatility of the fragrance is advantageous.

It has already been observed that some unstable perfume constituents are sometimes not very compatible with carrier materials and at least partially decompose after incorporation in the carrier, particularly when the carrier is a porous mineral carrier, such as, for example, clay, or zeolite, particularly dehydrated and/or activated zeolite. In the scope of this invention, unstable fragrances can be identified by incorporating a perfume composition comprising at least 6 fragrances in activated/dehydrated zeolite X and storing the resulting sample for 24 hours at room temperature. In order to determine the stability, the fragrances are then extracted with acetone and analyzed by gas chromatography. In the context of this invention, a fragrance is considered to be unstable if at least 50 wt. %, preferably at least 65 wt. %, advantageously at least 80 wt. %, particularly 95 wt. % of this fragrance have decomposed into decomposition products.

In a further preferred embodiment of the invention, the inventive composition comprises less than 15 wt. %, preferably less than 8 wt. %, advantageously less than 6 wt. %, even more advantageously less than 3 wt. % of unstable perfume, based on the total quantity of perfume, wherein the unstable perfume particularly includes the group of the allyl alcohol esters, esters of secondary alcohols, esters of tertiary alcohols, allylic ketones, condensation products of amines and aldehydes, acetals, ketals and their mixtures.

If the perfume that is ad/absorbed on/in the particles comprises at least 4, advantageously at least 5, further advantageously at least 6, even further advantageously at least 7, even more advantageously at least 8, preferably at least 9, particularly 10 different odoriferous compounds, then this constitutes a preferred embodiment of the invention.

If the log P value of the perfume components that are ad/absorbed on/in the particles is basically at least 2, preferably at least 3 or greater such that therefore at least 40%, advantageously at least 50%, further advantageously at least 60%, even more advantageously at least 70%, preferably at least 80%, particularly 90% of the perfume components meet this log-requirement, then this constitutes a preferred embodiment of the invention.

The log P value is a measure of the hydrophobicity of the perfume components. It is the $\log_{10}$ of the distribution coefficients between n-octanol and water. The octanol/water distribution coefficient of a perfume ingredient is the ratio between its equilibrium concentrations in water and octanol. A perfume ingredient with higher distribution coefficients P is more strongly hydrophobic. The cited conditions for log P are therefore advantageous, because they enable the fragrances to be better retained in the pores of the carrier material and can also be better deposited onto objects that are treated with the particles (for example, indirectly by treatment with a detergent formulation that comprises the inventive particles). The log P value of many perfume ingredients can be found in the literature; for example, the Pomona 92 databank, obtainable from Daylight Chemical Information Systems, Inc. (Daylog CIS), Irvine, California, contains many of these values, together with references to the original literature. The log P values can also be calculated, for example, by means of the "CLOG P" program from the same company Daylight CIS. In general, one refers to calculated log P values as CLOG P values. In the context of this invention, the term "log P values" also include the CLOG P values. Preferably, the CLOG P values for hydrophobicity estimates should be consulted when there are no experimental log P values available for specific perfume ingredients.

If desired, the perfume can also be combined with a perfume fixative. It is assumed that perfume fixatives can retard the evaporation of the highly volatile fractions of the perfume.

According to a further preferred embodiment, the perfume that is ab/adsorbed in/on the carrier material can comprise a perfume fixative, preferably in the form of diethyl phthalate, musk (derivatives) as well as mixtures thereof, wherein the amount of fixative is preferably 1 to 5 wt. %, advantageously 2 to 50 wt. %, more advantageously 10 to 45 wt. %, particularly 20 to 40 wt. % of the total amount of perfume.

According to a further preferred embodiment, the particles comprise an agent that increases the viscosity of liquids, in particular of perfume, preferably PEG (polyethylene glycol), advantageously with a molecular weight of 400 to 2,000, wherein the viscosity increasing agent is comprised, preferably in amounts of 0.1 to 20 wt. %, advantageously from 0.15 to 10 wt. %, further advantageously from 0.2 to 5 wt. %, particularly from 0.25 to 3 wt. %, based on the particles.

It has turned out that the agents that increase the viscosity of liquids, particularly of perfume, make a further contribution to the stability of the perfume in the particles, when nonionic surfactant is present at the same time.

The viscosity increasing agents are preferably polyethylene glycols (abbreviation: PEG), that can be described by the general formula I:

$$H—(O—CH_2—CH_2)_n—OH \quad (I),$$

in which the degree of polymerisation n can vary from ca. 5 to >100,000, corresponding to molecular weights of 200 to 5,000,000 $gmol^{-1}$. The products with molecular weights below 25,000 $gmol^{-1}$ are actually designated as polyethylene glycols, whereas higher molecular weight products are often designated in the literature as polyethylene oxides (abbreviation PEOX). The preferably used polyethylene glycols can have a linear or branched structure, wherein the linear polyethylene glycols are particularly preferred, and be end blocked.

The particularly preferred polyethylene glycols include those with relative molecular weights between 400 and 2,000. In particular, polyethylene glycols can also be used that are liquid at room temperature and a pressure of 1 bar; they are mainly polyethylene glycols with a relative molecular weight of 200, 400 and 600.

According to a further preferred embodiment of the invention, the carrier material or the particle is at least partially encapsulated by a coating that preferably comprises an at least partially water-soluble or at least partially water-dispersible component, selected from polyols, carbohydrates, starches, modified starches, starch hydrolyzates, cellulose and cellulose derivatives, natural and synthetic gums, silicates, borates, phosphates, chitin, and chitosan, water-soluble polymers, fatty components and mixtures thereof. Waxes and/or resins, for example, also come into consideration, e.g. beeswax, benzoin gum, carnauba wax, candelilla wax, coumarone-indene resin, copal, shellac, gum mastic, oxidized polyethylene wax or sandarac resin. Similarly, paraffins or gelatins, in particular also cellulose ethers are also suitable.

According to a further preferred embodiment, the coating includes polycarboxylates.

The particles can be coated by methods described in the prior art. The coating material preferably completely encapsulates each particle, but wherein a non-interconnected coating may also be desired. Any coating materials that are commonly used in connection with detergents and cleansing agents can be considered as the coating materials.

Materials that can be used as the coating materials in the context of the invention are any inorganic and/or organic substance and/or mixture of substances, preferably those that are sensitive to pH, temperature and/or ionic strength, such that depending on a change in pH, temperature and/or ionic strength they lose their integrity, i.e. partially or totally dissolve.

Polymers and/or copolymers that have film-forming properties and that can be advantageously applied from aqueous dispersions are particularly preferred as the coating materials. For many reasons (flammability, toxicity etc.), organic solvents are detrimental for the production of pH-sensitive coatings. Aqueous dispersions feature simple handling and eliminate all toxicological problems. The decisive parameter for the film-forming properties is the glass transition temperature of the film-forming polymer and/or copolymer. Above the glass temperature, the polymer or copolymer is elastic, meltable and flowable, whereas it is brittle below the glass temperature. Only above the glass transition temperature can the polymer be processed as is required for the formation of a film coating. The glass transition temperature can be influenced by the addition of low molecular weight substances with plasticizing properties, the so-called plasticizers. Plasticizers can also be added in the aqueous dispersion besides the polymer. All substances that lower the glass transition temperature of the preferably pH-sensitive polymers and/or copolymers that are used are suitable plasticizers. The polymer can then be coated at lower temperatures, optionally even at room temperature. Particularly preferred plasticizers are esters of citric acid (preferably tributyl citrate and/or triethyl citrate), esters of phthalic acid (preferably dimethyl phthalate, diethyl phthalate and/or dibutyl phthalate), esters of organic polyalcohols (preferably glycerol triacetate), polyalcohols (preferably glycerol, propylene glycol) and/or polyoxyethylene glycols (preferably polyethylene glycol). The plasticizer resides between the polymer chains, thereby increasing the mobility, lowers the interactions and thus prevents abrasion and splitting by reducing the brittleness.

It is particularly advantageous when the coating material comprises a polyacrylate and/or a derivative thereof and/or a corresponding copolymer based on acrylic acid esters or acrylic acid and other monomers. Copolymers of acrylamide and acrylic acid and/or their derivatives are particularly advantageous for the inventive coating material.

When the carrier material or the particle is at least partially encapsulated by a coating that comprises an at least partially water-soluble or at least partially water-dispersible component that comprises 0 wt. % to 80 wt. % of at least one solid polyol with preferably more than 3 hydroxyl groups and 20 wt. % to 100 wt. % of a liquid diol or polyol in which the perfume is essentially insoluble and in which the solid polyol is essentially soluble, wherein the cited liquid polyol or diol is preferably selected from glycerin, ethylene glycol and diglycerin or mixtures of these and wherein the solid polyol is selected from glucose, sorbitol, maltose, glucamine, saccharose, polyvinyl alcohol, starch, alkyl polyglycoside, sorbitan fatty esters, polyhydroxy fatty acid amides, whose fatty acid groups comprise 1 to 18 carbon atoms, and mixtures of these, then this constitutes a further preferred embodiment of the invention.

According to a preferred embodiment, the inventive particle comprises (a) inorganic carrier material in amounts of 50 to 95 wt. %, preferably 60 to 90 wt. %

(b) perfume in amounts of 0.5 to 40 wt. %, preferably 1 to 35 wt. %

(c) nonionic surfactant in amounts of 0.1 wt. % to 30 wt. %, preferably from 0.5 wt. % to 10 wt. %, particularly 1 to 5 wt. %.

(d) auxiliaries in amounts of 0 wt. % to 15 wt. %, preferably from 0.5 wt. % to 10 wt. %, advantageously 0.75 to 7.5 wt. %, in particular 1 to 5 wt. %.

The auxiliaries preferably concern polymeric substances such as carboxymethyl cellulose, polyacrylates, polycarboxylates and generally carrier materials that do not belong to the inventive inorganic carrier materials.

A further subject matter of the invention is constituted by a process for the manufacture of an inventive particle, comprising (a) the preparation of the inventive carrier material, preferably based on aqueous suspensions of inorganic and organic ingredients that advantageously include nonionic surfactant, wherein the aqueous suspensions are subsequently dried, then (b) optionally the impregnation of the inventive carrier material with at least one nonionic surfactant, and (c) loading the carrier material with perfume by blending perfume and (the impregnated) carrier material and/or by spraying perfume onto the (impregnated) carrier material, and optionally coating the perfumed carrier material.

The preparation of the inventive carrier material is carried out according to the process step a), preferably based on aqueous suspensions of inorganic and organic ingredients that advantageously include nonionic surfactant, wherein the aqueous suspensions are subsequently dried. Thus, a carrier material is preferably used that comprises nonionic surfactant with the production.

It is particularly preferred when carbon dioxide is produced in the dried material during the drying of the aqueous suspension.

For drying, each industrial drying possibility is meant in the broadest sense with which water and/or other solvents can be removed from the aqueous suspensions so effectively that at the end of the drying, particles i.e. particulate solids result that constitute the desired carrier material. Naturally, these particles do not have to be entirely solvent-free and/or anhydrous; they may, for example, still comprise significant amounts of solvent and/or water; preferably, however, they have water contents below 30 wt. %, advantageously below 25 wt. %, particularly below 20 wt. %, each based on the solids that result at the end of the drying. If required, the water content can also be lower, for example, below 15 wt. % or below 10 wt. % or below 5 wt. %, each based on the solids that result at the end of the drying step.

For drying, heat is advantageously supplied to the material being dried. Preferably, the drying can be accomplished in a direct current, counter current or cross current. Contact driers, convection driers and radiation driers are differentiated according to the type of heat supply. Depending on the pressure used in the drier, the driers can be subdivided into overpressure, normal pressure and vacuum driers. In convection driers, the heat is transferred to the goods being dried mainly by hot gases (air or inert gas), which is preferred. For this, tunnel dryers, chamber dryers, cabinet dryers, column dryers, fluidized bed dryers and spray dryers are used, which is preferred. For contact drying, which is also preferred, the heat transfer is made over heat exchanger surfaces. Contact dryers include drum dryers, tubular dryers and cabinet dryers. Rack dryers, plate dryers, drum dryers and paddle dryers operate according to both principles of heat supply.

According to the invention, a very preferred drying method is spray drying. Similarly preferred drying methods are fluidized bed processes.

According to a preferred embodiment of the invention, the aqueous suspension to be dried according to the invention comprises substances that release carbon dioxide at increased temperatures, and are preferably selected from hydrogen carbonate compounds, citric acid and/or aconitic acid. Sodium hydrogen carbonate is the preferred hydrogen carbonate compound.

In a further preferred embodiment of the invention, the aqueous suspension to be dried according to the invention comprises 0 to 40 wt. %, preferably up to 0.1 to 4 wt. %, particularly up to 1 to 3 wt. % citric acid, or 0 to 50 wt. %, preferably 0.1 to 5 wt. %, preferably 1 to 4 wt. % hydrogen carbonate compounds, or 0 to 40 wt. %, preferably 0.1 to 10 wt. %, particularly 1 to 5 wt. % of aconitic acid.

It may also be advantageous to use mixtures of hydrogen carbonate compounds, citric acid and/or aconitic acid, wherein the total amount of such should not exceed 50 wt. %, preferably 40 wt. %, advantageously 20 wt. %, but in particular 10 wt. %, and wherein a minimum total quantity should not fall below 0.1 wt. %, preferably 1 wt. %, each based on the total suspension.

Surprisingly, it was determined that in such cases where carbon dioxide is released during the drying, particles result that are characterized by an even further improved perfume-absorption capability.

If after manufacture, the prepared carrier material still contains no nonionic surfactant, then the inventive carrier material is impregnated with at least one nonionic surfactant. On the other hand, when the prepared carrier material already comprises nonionic surfactant from production, then the user decides whether to impregnate the inventive carrier material with at least one nonionic surfactant, depending on whether the nonionic surfactant loading should be increased or not.

Finally, the carrier material that comprises nonionic surfactant is loaded with perfume by blending or spraying, as illustrated above.

A further subject of the invention is constituted by a detergent composition comprising:

(A) inventive particles (B) 0.01 wt. % to 95 wt. %, preferably 5 wt. % to 85 wt. %, preferably 3 wt. % to 30 wt. %, and more preferably 5 wt. % to 22 wt. % of additional surfactant(s).

The detergent compositions can be preferably cleansing agents, (fabric) care agents or detergents.

If the additional surfactant includes anionic surfactant, preferably in a proportion of at least 50 wt. % based on the total amount of additional surfactant, then this concerns a preferred embodiment, wherein it is further preferred that the additional surfactant includes a mixture of anionic and nonionic surfactants.

An inventive detergent composition that includes at least one surfactant, preferably at least two from the group of the alkylbenzene sulfonates, alkyl ester sulfonates, alkyl ethoxylates, alkylphenol alkoxylates, alkyl polyglucosides, alkyl sulfates, alkyl ethoxy sulfate, secondary alkyl sulfates and/or mixtures thereof, wherein these additional surfactants are comprised advantageously in amounts of 1 wt. % to 75 wt. % based on the total composition, represent a preferred embodiment.

The detergent composition comprises, as described, additional surfactants besides the surfactant comprised in the inventive particles. Advantageous surfactants are described below.

Exemplary suitable anionic surfactants are those of the sulfonate and sulfate type. Suitable surfactants of the sulfonate type are, advantageously $C_{9-13}$-alkylbenzene sulfonates, olefin sulfonates, i.e. mixtures of alkene- and hydroxyalkane sulfonates, and disulfonates, as are obtained, for example, from $C_{12-18}$-monoolefins having a terminal or internal double bond, by sulfonation with gaseous sulfur trioxide and subsequent alkaline or acidic hydrolysis of the sulfonation products. Those alkane sulfonates, obtained from $C_{12-18}$ alkanes by sulfochlorination or sulfoxidation, for example, with subsequent hydrolysis or neutralization, are also suitable. The esters of α-sulfofatty acids (ester sulfonates), e.g. the α-sulfonated methyl esters of hydrogenated coco-, palm nut- or tallow acids are likewise suitable.

Further suitable anionic surfactants are sulfated fatty acid esters of glycerine. They include the mono-, di- and triesters and also mixtures of them, such as those obtained by the esterification of a monoglycerin with 1 to 3 moles fatty acid or the transesterification of triglycerides with 0.3 to 2 moles glycerin. Preferred sulfated fatty acid esters of glycerol in this case are the sulfated products of saturated fatty acids with 6 to 22 carbon atoms, for example, caproic acid, caprylic acid, capric acid, myristic acid, lauric acid, palmitic acid, stearic acid or behenic acid. Preferred alk(en)yl sulfates are the alkali and especially sodium salts of the sulfuric acid half-esters derived from the $C_{12}$-$C_{18}$ fatty alcohols, for example, from coconut butter alcohol, tallow alcohol, lauryl, myristyl, cetyl or stearyl alcohol or from $C_{10}$-$C_{20}$ oxo alcohols and those half-esters of secondary alcohols of these chain lengths. Additionally preferred are alk(en)yl sulfates of the said chain lengths, which contain a synthetic, straight-chained alkyl group produced on a petro-chemical basis and which show similar degradation behaviour to the suitable compounds based on fat chemical raw materials. The $C_{12}$-$C_{16}$ alkyl sulfates and $C_{12}$-$C_{15}$ alkyl sulfates and $C_{14}$-$C_{15}$ alkyl sulfates are preferred on the grounds of laundry performance. The 2,3-alkyl sulfates, which are manufactured according to the U.S. Pat. No. 3,234,258 or U.S. Pat. No. 5,075,041, and which can be obtained from Shell Oil Company under the trade name DAN®, are also suitable anionic surfactants. Sulfuric acid mono-esters derived from straight-chained or branched $C_{7-21}$ alcohols ethoxylated with 1 to 6 moles ethylene oxide are also suitable, for example, 2-methyl-branched $C_{9-11}$ alcohols with an average of 3.5 mole ethylene oxide (EO) or $C_{12-18}$ fatty alcohols with 1 to 4 EO. Due to their high foaming performance, they are only used in fairly small quantities in cleansing agents, for example, in amounts of 1 to 5% by weight.

Other suitable anionic surfactants are the salts of alkylsulfosuccinic acid, which are also referred to as sulfosuccinates or esters of sulfosuccinic acid and the monoesters and/or di-esters of sulfosuccinic acid with alcohols, preferably fatty alcohols and especially ethoxylated fatty alcohols. Preferred sulfosuccinates contain $C_{8-18}$ fatty alcohol groups or mixtures of them. Especially preferred sulfosuccinates comprise a fatty alcohol group derived from ethoxylated fatty alcohols and may be considered as nonionic surfactants (see description below). Once again the especially preferred sulfosuccinates are those, whose fatty alcohol groups are derived from ethoxylated fatty alcohols with narrow range distribution. It is also possible to use alk(en)ylsuccinic acid with preferably 8 to 18 carbon atoms in the alk(en)yl chain, or salts thereof.

Soaps in particular can be considered as further anionic surfactants. Saturated fatty acid soaps are suitable, such as the salts of lauric acid, myristic acid, palmitic acid, stearic acid, hydrogenated erucic acid and behenic acid, and especially soap mixtures derived from natural fatty acids such as coconut oil fatty acid, palm kernel oil fatty acid or tallow fatty acid.

Anionic surfactants, including soaps may be in the form of their sodium, potassium or ammonium salts or as soluble salts of organic bases, such as mono-, di- or triethanolamine. Preferably, the anionic surfactants are in the form of their sodium or potassium salts, especially in the form of sodium salts.

Preferred nonionic surfactants (additional surfactants) are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may comprise linear and methyl-branched groups in the mixture typically present in oxoalcohol groups. Particularly preferred are, however, alcohol ethoxylates with linear groups from alcohols of natural origin with 12 to 18 carbon atoms, e.g. from coco-, palm-, tallow- or oleyl alcohol, and an average of 2 to 8 EO per mole alcohol. Exemplary preferred ethoxylated alcohols include $C_{12-14}$-alcohols with 3 EO or 4 EO, $C_{9-11}$-alcohols with 7 EO, $C_{13-15}$-alcohols with 3 EO, 5 EO, 7 EO or 8 EO, $C_{12-18}$-alcohols with 3 EO, 5 EO or 7 EO and mixtures thereof, as well as mixtures of C12-14-alcohols with 3 EO and C12-18-alcohols with 5 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these nonionic surfactants, fatty alcohols with more than 12 EO can also be used. Examples of these are tallow fatty alcohol with 14 EO, 25 EO, 30 EO or 40 EO.

Furthermore, as further nonionic surfactants (additional surfactants), alkyl glycosides that satisfy the general Formula $RO(G)_x$ can also be added, where R means a primary linear or methyl-branched, particularly 2-methyl-branched, aliphatic group containing 8 to 22 and preferably 12 to 18 carbon atoms and G stands for a glycose unit containing 5 or 6 carbon atoms, preferably glucose. The degree of oligomerization x, which defines the distribution of monoglycosides and oligoglycosides, is any number between 1.0 and 10, preferably between 1.2 and 1.4.

Another class of preferred nonionic surfactants (additional surfactants), which are used either as the sole nonionic surfactant or in combination with other nonionic surfactants, are alkoxylated, preferably ethoxylated or ethoxylated and propoxylated fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International Patent application WO-A-90/13533.

Nonionic surfactants of the amine oxide type, for example, N-cocoalkyl-N,N-dimethylamine oxide and N-tallow alkyl-N,N-dihydroxyethylamine oxide, and the fatty acid alkanolamides may also be suitable as additional surfactants. The quantity in which these nonionic surfactants are used is preferably no more than the quantity in which the ethoxylated fatty alcohols are used and, particularly no more than half that quantity.

Other suitable surfactants are polyhydroxy fatty acid amides corresponding to the Formula (II),

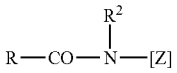

(II)

in which RCO stands for an aliphatic acyl group with 6 to 22 carbon atoms, $R^2$ for hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxyfatty acid amides are known substances, which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to the Formula (III),

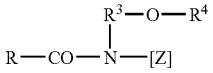

(III)

in which R is a linear or branched alkyl or alkenyl group containing 7 to 12 carbon atoms, $R^3$ is a linear, branched or cyclic alkyl group or an aryl group containing 2 to 8 carbon atoms and $R^4$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxy groups, or alkoxylated, preferably ethoxylated or propoxylated derivatives of that group.

[Z] is preferably obtained by reductive amination of a reduced sugar, for example, glucose, fructose, maltose, lactose, galactose, mannose or xylose. The N-alkoxy- or N-aryloxy-substituted compounds may then be converted, for example, according to the teaching of International Application WO-A-95/07331, into the required polyhydroxyfatty acid amides by reaction with fatty acid methyl esters in the presence of an alkoxide as catalyst.

The inventive detergent compositions, such as cleansing agents, care agents and detergents, can optionally also comprise cationic surfactants. Suitable cationic surfactants are, for example, surface-active quaternary compounds, in particular with an ammonium, sulfonium, phosphonium, iodonium or arsonium group, as described, for example, by K. H. Wallhäusser in "Praxis der Sterilisation, Desinfektion-Konservierung: Keimidentifizierung-Betriebshygiene" (5th Edition, Stuttgart/New York: Thieme, 1995), as antimicrobials. By adding quaternary surface-active compounds with antimicrobial action, the composition can be furnished with an antimicrobial action or its existing antimicrobial action, resulting from the possible presence of other ingredients, can be improved.

Particularly preferred cationic surfactants are the quaternary, in some cases antimicrobially active ammonium compounds (QUATS; INCI Quaternary Ammonium Substances) according to the general formula $(R^I)(R^{II})(R^{III})(R^{IV})N^+X^-$, in which $R^I$ to $R^{IV}$ may be the same or different $C_{1-22}$ alkyl groups, $C_{7-28}$ aralkyl groups or heterocyclic groups, wherein two or—in the case of an aromatic compound, such as pyridine—even three groups together with the nitrogen atom form the heterocycle, for example, a pyridinium or imidazolinium compound, and $X^-$ represents halide ions, sulfate ions, hydroxide ions or similar anions. In the interests of optimal antimicrobial activity, at least one of the substituents preferably has a chain length of 8 to 18 and, more preferably, 12 to 16 carbon atoms.

QUATS can be obtained by reacting tertiary amines with alkylating agents such as, for example, methyl chloride, benzyl chloride, dimethyl sulfate, dodecyl bromide but also ethylene oxide. The alkylation of tertiary amines having one long alkyl chain and two methyl groups is particularly easy. The quaternization of tertiary amines containing two long chains and one methyl group can also be carried out under mild conditions using methyl chloride. Amines containing three long alkyl chains or hydroxy-substituted alkyl chains lack reactivity and are preferably quaternized with dimethyl sulfate.

Suitable QUATS are, for example, benzalkonium chloride (N-alkyl-N,N-dimethylbenzyl ammonium chloride, CAS No. 8001-54-5), benzalkon B (m,p-dichlorobenzyl dimethyl-$C_{12}$-alkyl ammonium chloride, CAS No. 58390-78-6), benzoxonium chloride (benzyldodecyl-bis-(2-hydroxyethyl) ammonium chloride), cetrimonium bromide (N-hexadecyl-N,N-trimethyl ammonium bromide, CAS No. 57-09-0), benzetonium chloride (N,N-di-methyl-N-[2-[2-[p-(1,1,3,3-tetramethylbutyl)-phenoxy]ethoxy]-ethyl]-benzyl ammonium chloride, CAS No. 121-54-0), dialkyl dimethyl ammonium chlorides, such as di-n-decyl dimethyl ammonium chloride (CAS No. 7173-51-5-5), didecyl dimethyl ammonium bromide (CAS No. 2390-68-3), dioctyl dimethyl ammonium chloride, 1-cetylpyridinium chloride (CAS No. 123-03-5) and thiazoline iodide (CAS No. 15764-48-1) and mixtures thereof. Preferred QUATS are the benzalkonium chlorides containing $C_{8-18}$ alkyl groups, more particularly $C_{12-14}$ alkyl benzyl dimethyl ammonium chloride. A particularly preferred QUAT is cocopentaethoxy methyl ammonium methosulfate (INCI PEG-5 Cocomonium Methosulfate; Rewoquat® CPEM).

To avoid possible incompatibilities of the antimicrobial cationic surfactants with the anionic surfactants comprised in the inventive detergent composition, cationic surfactants that are the most compatible possible with anionic surfactants and/or as little as possible cationic surfactant are employed, or in a particular embodiment of the invention, antimicrobially active cationic surfactants are dispensed with altogether.

Parabens, benzoic acid and/or benzoate, lactic acid, salicylic acid and/or lactates can be added as the antimicrobially active substances. Benzoic acid and/or lactic acid are particularly preferred.

The inventive detergent compositions, such as cleansing agents, care agents and detergents can comprise one or more cationic surfactants in amounts, based on the total composition, of 0 to 5 wt. %, greater than 0 to 5 wt. %, preferably 0.01 to 3 wt. %, particularly 0.1 to 1 wt. %.

Likewise, the inventive detergent compositions, such as cleansing agents, care agents and detergents, can also comprise amphoteric surfactants. Suitable amphoteric surfactants are for example, betaines of the Formula $(R^1)(R^2)(R^3)N^+CH_2CO^-$, in which $R^1$ means an alkyl group with 8 to 25, preferably 10 to 21 carbon atoms, optionally interrupted by heteroatoms or heteroatomic groups, and $R^2$ and $R^3$ mean the same or different alkyl groups with 1 to 3 carbon atoms, in particular $C_{10}$-$C_{22}$ alkyl dimethyl carboxymethyl betaine and $C_{11}$-$C_{17}$ alkyl amidopropyl dimethyl carboxymethyl betaine. Furthermore, the addition of alkylamido alkylamines, alkyl substituted amino acids, acylated amino acids or bio surfactants as the amphoteric surfactants into the inventive compositions, such as cleansing agents, care agents and detergents, is conceivable.

The inventive detergent compositions, such as cleansing agents, care agents and detergents can comprise one or more amphoteric surfactants in amounts, based on the total composition, of 0 to 5 wt. %, greater than 0 to 5 wt. %, preferably 0.01 to 3 wt. %, particularly 0.1 to 1 wt. %.

Besides the active washing substances, builders are the most important ingredients of detergents and cleansing agents, in particular therefore zeolites silicates, carbonates, organic co builders and also—where there are no ecological reasons preventing their use—phosphates. Accordingly, the detergent compositions can also comprise still further builders besides those already present in the inventive particles. Therefore, if the detergent composition further includes at least 1 wt. % of an additional detergent builder, then this constitutes a further preferred embodiment of the invention, wherein it is also preferred if additional customary additive components for detergents and cleansing agents are comprised.

Exemplary additional builders are, in particular, the already cited advantageously, preferably crystalline, layered sodium silicates or amorphous silicates. Zeolite, preferably zeolite A and/or P, is also advantageous. Zeolite MAP® (commercial product of the Crosfield company), is particularly preferred as the zeolite P. However, the zeolites X as well as mixtures of A, X and/or P are also suitable. Commercially available and preferred in the context of the present invention is, for example, also a co-crystallizate of zeolite X and zeolite A (ca. 80 wt. % zeolite X), which is marketed under the name of VEGOBOND AX® by Condea Augusta S.p.A. and which can be described by the Formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}$$

The zeolite can be used both as the additional builder and also for dusting the particles. Suitable zeolites have a mean particle size of less than 10 μm (volume distribution, as measured by the Coulter Counter Method) and comprise preferably 18 to 22% by weight and more preferably 20 to 22% by weight of bound water.

Naturally, other additional customary builders can also be advantageously added, e.g. possibly the well known phosphates as builders in the detergent formulation, in so far that their use should not be avoided on ecological grounds. The sodium salts of the orthophosphates, the pyrophosphates and especially the tripolyphosphates are particularly suitable.

Useful organic builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing such a use is not ecologically unsafe, and mixtures thereof. Preferred salts are the salts of polycarboxylic acids such as citric acid, adipic acid, succinic acid, glutaric acid, tartaric acid, sugar acids and mixtures thereof.

Besides the already mentioned ingredients, additional customary detergent and cleansing agent ingredients can be incorporated or comprised therein, in particular from the group of the bleaching agents, bleach activators, enzymes, enzyme stabilizers, fluorescent agents, colorants, hydrotropes, foam inhibitors, silicone oils, anti-redeposition agents, optical brighteners, graying inhibitors, color transfer inhibitors and corrosion inhibitors. Further optionally usable ingredients are preferably from the group of the oligo- and polymeric polycarboxylates, pH-adjustors, fluorescent agents, shrink preventers, wetting agents, antimicrobials, germicides, fungicides, antioxidants, antistats, ironing auxiliaries, water proofing and impregnation agents, swelling and antipilling agents, sequestrants, fabric softeners and UV absorbers.

Among the compounds, which serve as bleach agents and liberate $H_2O_2$ in water, sodium perborate tetrahydrate and sodium perborate monohydrate are of particular importance. Examples of further bleaching agents that may be employed are sodium percarbonate, peroxypyrophosphates, citrate perhydrates and $H_2O_2$-liberating peracidic salts or peracids, such as perbenzoates, peroxyphthalates, diperoxyazelaic acid, phthaloimino peracid or diperoxydodecanedioic acid.

In order to achieve an improved bleaching action for washing temperatures of 60° C. and below, bleach activators can be incorporated as the sole ingredient or as an ingredient of component b). Bleach activators, which can be used are compounds which, under perhydrolysis conditions, yield aliphatic peroxycarboxylic acids having preferably 1 to 10 carbon atoms, in particular 2 to 4 carbon atoms, and/or optionally substituted perbenzoic acid. Substances, which carry O-acyl and/or N-acyl groups of said number of carbon atoms and/or optionally substituted benzoyl groups, are suitable. Preference is given to polyacylated alkylenediamines, in particular tetraacetyl ethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenol sulfonates, in particular n-nonanoyl- or isononanoyloxybenzene sulfonate (n- or iso-NOBS), carboxylic acid anhydrides, in particular phthalic anhydride, acylated polyhydric alcohols, in particular triacetin, ethylene glycol diacetate and 2,5-diacetoxy-2,5-dihydrofuran.

In addition to, or instead of the conventional bleach activators, so-called bleach catalysts may also be incorporated. These substances are bleach-boosting transition metal salts or transition metal complexes such as, for example, manganese-, iron-, cobalt-, ruthenium- or molybdenum-salen complexes or -carbonyl complexes. Manganese, iron, cobalt, ruthenium, molybdenum, titanium, vanadium and copper complexes with nitrogen-containing tripod ligands, as well as cobalt-, iron-, copper- and ruthenium-amine complexes may also be employed as the bleach catalysts.

Suitable enzymes are those from the classes of proteases, lipases, amylases, cellulases or mixtures thereof. Enzymatic active materials obtained from bacterial sources or fungi such as bacillus subtilis, bacillus licheniformis and streptomyceus griseus are particularly well suited. Proteases of the subtilisin type and particularly proteases that are obtained from bacillus lentus, are preferably used. Here, mixtures of enzymes are of particular interest, for example, protease and amylase or protease and lipase or protease and cellulase or cellulase and lipase or protease, amylase and lipase or protease, lipase and cellulase, in particular, however, cellulase-containing mixtures. Peroxidases or oxidases have also proved to be suitable in certain cases. The enzymes can be adsorbed on carriers and/or embedded in encapsulants, in order to protect them against premature decomposition. The content of the enzymes, enzyme mixtures or enzyme granulates in the inventive compositions can be, for example, about 0.1 to 5% by weight and is preferably 0.1 to about 2% by weight.

In addition, the compositions can also comprise components that positively influence the oil and fat removal from textiles during the wash (so-called soil repellents). This effect is particularly noticeable when a textile is dirty and had been previously already washed several times with an inventive detergent that comprised this oil- or fat-removing component. The preferred oil and fat removing components include, for example, nonionic cellulose ethers such as methyl cellulose and methyl hydroxypropyl cellulose with a content of methoxy groups of 15 to 30 wt. % and hydroxypropoxy groups of 1 to 15 wt. %, each based on the nonionic cellulose ether, as well as polymers of phthalic acid and/or terephthalic acid or their derivatives known from the prior art, particularly polymers of ethylene terephthalates and/or polyethylene glycol terephthalates or anionically and/or nonionically modified derivatives thereof. From these, the sulfonated derivatives of the phthalic acid polymers and the terephthalic acid polymers are particularly preferred.

The compositions may comprise derivatives of diaminostilbene disulfonic acid or alkali metal salts thereof as the optical brighteners. Suitable optical brighteners are, for example, salts of 4,4'-bis-(2-anilino-4-morpholino-1,3,5-triazinyl-6-amino)stilbene-2,2'-disulfonic acid or compounds of similar structure which contain a diethanolamino group, a methylamino group, an anilino group or a 2-methoxyethylamino group instead of the morpholino group. Brighteners of the substituted diphenylstyryl type may also be present, for example, the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. Mixtures of the mentioned brighteners may also be used.

In order to enhance the esthetic impression of the compositions of the invention, they may be colored with appropriate colorants. Preferred colorants, which are not difficult for the expert to choose, have high storage stability, are not affected by the other ingredients of the detergents or by light and do not have any pronounced substantivity for the textile fibers being treated, so as not to color them.

If the inventive detergent composition is in the form of agglomerates and the density of the detergent composition is advantageously at least 300 g/l, advantageously 400 g/l, more advantageously 500 g/l, preferably at least 600 g/l and in particular at least 650 g/l, then this also constitutes a preferred embodiment of the invention.

If, moreover, the inventive detergent composition includes a second perfume that is sprayed onto the surface of the comprised detergent granules, then this again constitutes a preferred embodiment of the invention.

A further preferred embodiment is an inventive detergent composition in the form of a laundry detergent unit, preferably in tablet form.

A further subject matter of this invention again concerns a process for washing fabrics, including the step of contacting the fabric with an aqueous medium that comprises an effective quantity of an inventive detergent composition that comprises the previously described features.

Another subject matter of this invention consists in the use of nonionic surfactant to increase the perfume receptivity of carrier materials as well as to preferably stabilize the perfume in the carrier material, as well as to advantageously produce a delayed fragrance effect, as described above, as well as to achieve an enhanced fragrance effect.

EXAMPLES

Four different particles were manufactured in a standard spray-drying process.

Particle 1: consisted of 78 wt. % zeolite A (anhydrous active substance), 2 wt. % sodium salt of carboxymethyl cellulose, 0.5 wt. % sodium hydroxide, 2 wt. % sodium sulfate, 1.45 wt. % $C_{12}$-$C_{18}$ fatty alcohol with 4.5 EO, 0.5 wt. % $C_{12}$-$C_{18}$ fatty alcohol with 7 EO as well as a residue (water, salts, impurities) of 15.55 wt. %.

Particle 2: consisted of 78 wt. % zeolite A (anhydrous active substance), 2 wt. % sodium salt of carboxymethyl cellulose, 0.5 wt. % sodium hydroxide, 2 wt. % sodium sulfate, 1.95 wt. % $C_{12}$-$C_{18}$ fatty alcohol with 4.5 EO, as well as a residue (water, salts, impurities) of 15.55 wt. %.

Particle 3: consisted of 78 wt. % zeolite A (anhydrous active substance), 2 wt. % sodium salt of carboxymethyl cellulose, 0.5 wt. % sodium hydroxide, 2 wt. % sodium sulfate, 1.95 wt. % $C_{12}$-$C_{18}$ fatty alcohol with 7 EO, as well as a residue (water, salts, impurities) of 15.55 wt. %.

Particle 4 (control granule): consisted of 79.95 wt. % zeolite A (anhydrous active substance), 2 wt. % sodium salt of carboxymethyl cellulose, 0.5 wt. % sodium hydroxide, 2 wt. % sodium sulfate, as well as a residue (water, salts, impurities) of 15.55 wt. %.

These particles, each with a bulk density of about 600 g/l and which had a comparable particle size distribution, were then loaded with perfume, in fact by mixing the perfume and the particles in a standard mixing unit. The following values were obtained for the perfume take-up by each of the granules.

Granule 1: quantity of perfume taken-up: ca. 30 wt. %

Granule 2: quantity of perfume taken-up: ca. 30 wt. %

Granule 3: quantity of perfume taken-up: ca. 30 wt. %

Granule 4: quantity of perfume taken-up: ca. 20 wt. %

The quantity of the perfume taken-up is based on the respective perfume-free particles. For this, the particles were weighed before and after the perfume loading and the increase in weight determined. The increase in weight reflects the maximum perfume take-up of each particle. The particles had a good pourability and were not sticky. When the quantity of perfume taken-up is given as 30 wt. %, then this means, to give a concrete example, that 100 g particles, after loading with perfume, weigh 130 g.

Thus, it was found that the particles that comprised nonionic surfactant could take-up significantly more perfume than the granule that was free of nonionic surfactant. The increase was about 50%. The granules remained freely pourable and were not sticky, in spite of the high perfume loading.

The invention claimed is:

1. A process for the manufacture of a particle comprising the steps of a) providing an aqueous suspension comprised of from 0.50 wt. % to 30 wt. % of a nonionic surfactant and an inorganic carrier material selected from the group consisting of zeolites, sulfates, carbonates, silicates, silica, and combinations thereof; b) removing the water from the suspension by spray drying to produce particles; c) loading the particles from step (b) with perfume by blending perfume/or by spraying perfume onto the carrier material, to produce particles comprised of at least 60% by weight of the carrier material, from 1% to 3% by weight of the nonionic surfactant and at least 15% by weight of the perfume and wherein the particles are free of gas-tight coating layers.

2. A process for washing fabrics, including the step of contacting the fabrics with an aqueous medium that comprises an effective quantity of a detergent composition produced by the process according to claim 1.

3. The process of claim 1 wherein the nonionic surfactant comprises at least one alkoxylated alcohol.

4. The process of claim 3 wherein the alkoxylated alcohol is an ethoxylated primary alcohol having from 8 to 18 carbon atoms and from 1 to 12 moles of an alkylene oxide.

5. The process of claim 4 wherein the alkylene oxide is ethylene oxide.

6. The process of claim 1 wherein the amount of the inorganic carrier material is at least 70 wt. %.

7. The process of claim 1 wherein the particles further comprise at least one additional carrier material in a total amount of below 5 wt. %.

8. The process of claim 1 wherein the amount of the perfume is at least 25 wt. % based on the total weight of the particle.

9. The process of claim 1 wherein the non ionic surfactant is selected from the group consisting of alkoxylated alcohols, alkylphenol polyglycol ethers, alkoxylated fatty acids alkyl esters, polyhydroxy fatty acid amides, alkyl glycosides, alkyl polyglucosides, amine oxides and long chain alkyl sulfoxides.

10. The process of claim 3 wherein the alkoxylated alcohol is an ethoxylated primary alcohol having from 1 to 12 moles of alkylene oxide per mol of alcohol.

11. The process of claim 1 wherein the inorganic carrier material comprises 40 wt. % of zeolites.

* * * * *